US006777154B2

(12) United States Patent
Takahashi et al.

(10) Patent No.: US 6,777,154 B2
(45) Date of Patent: Aug. 17, 2004

(54) TONER FOR LIQUID DEVELOPER, LIQUID DEVELOPER, IMAGE FORMING DEVICE, AND IMAGE FORMING METHOD

(75) Inventors: Toru Takahashi, Kawasaki (JP); Makoto Fukuda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/265,274

(22) Filed: Oct. 7, 2002

(65) Prior Publication Data

US 2003/0143476 A1 Jul. 31, 2003

(30) Foreign Application Priority Data

Jan. 18, 2002 (JP) ..... 2002-010375

(51) Int. Cl.[7] ..... G03G 9/13

(52) U.S. Cl. ..... 430/114; 430/116; 430/117; 399/237

(58) Field of Search ..... 430/114, 116, 430/117; 399/237

(56) References Cited

U.S. PATENT DOCUMENTS 5,378,574 A * 1/1995 Winnik et al. ..... 430/115
5,643,707 A * 7/1997 Larson et al. ..... 430/137.22
5,955,233 A * 9/1999 Urashima et al. ..... 430/109.2
6,261,732 B1 * 7/2001 Morrison et al. ..... 430/117

FOREIGN PATENT DOCUMENTS

| | | |
|---|---|---|
| JP | 08-152739 | 6/1996 |
| JP | 09-230625 | 9/1997 |
| WO | WO97/07431 | 2/1997 |

* cited by examiner

*Primary Examiner*—John L Goodrow
(74) *Attorney, Agent, or Firm*—Armstrong, Kratz, Quintos, Hanson & Brooks, LLP

(57) ABSTRACT

A toner for a liquid developer and the like which have low cohesive force and excellent dispersion stability and storage stability and which enable formation of high-quality images and are highly reliable. The toner for a liquid developer comprises an epoxy compound whose epoxy equivalent weight is 1000 or less. An aspect in which the epoxy compound is at least one selected from bisphenol A epoxy resins, novalak epoxy resins, bisphenol F epoxy resins, biphenyl epoxy resins, isocyanate-modified epoxy resins, naphthalene epoxy resins, dicyclo epoxy resins, and brominated epoxy resins, and the like are preferable.

13 Claims, 3 Drawing Sheets

TONER FOR LIQUID DEVELOPER, LIQUID DEVELOPER, IMAGE FORMING DEVICE, AND IMAGE FORMING METHOD

BACKGROUND OF THE INVENTION

1. Field of the Invention

The present invention relates to a toner for a liquid developer and a liquid developer using the toner for a liquid developer which are suitable for making a latent image, which is formed on a photoconductor, a visible image in electrophotography, electrostatic recording, or the like, and to an image forming device and an image forming method using the toner for a liquid developer and the liquid developer.

2. Description of the Related Art

Currently, devices utilizing an electrophotographic recording method are widely used as copiers, high speed/high printing quality printers, and the like. An electrophotographic recording method is a so-called Carlson process which, as disclosed in U.S. Pat. Nos. 2,297,691 and 2,357,809, utilizes a photoconductor as a latent image recording medium, and carries out recording uniformly in seven processes which are image exposure, development, transfer, fixing, charge elimination, and cleaning. Namely, in the electrophotographic recording method, first, the surface of a photoconductor which is photoconductive is uniformly electrostatically charged either positive or negative, and after uniform charging, laser light or the like is irradiated. The surface charges at specific portions are eliminated so as to carry out image exposure which forms, on the photoconductor, an electrostatic latent image corresponding to image information. Then, due to the formed electrostatic latent image being electrostatically developed by a toner, a visible image is formed by the toner on the photoconductor. Finally, this visible image is electrostatically transferred onto a recording paper and is fused and fixed by heat, light, pressure or the like so as to obtain a printed matter.

In recent years, as the processing speeds of computers have improved and the internet and intranets and the like have become more popular, the trend towards electronic graphics and documents has advanced. Accompanying this trend, the demand for a so-called POD (Print on Demand) system, in which only the necessary amount of highly detailed images of a level on par with that of conventional offset printing is printed at the needed time, has rapidly increased, and another look is being taken at the usefulness of wet-type developing systems which are advantageous in obtaining high image quality (Kurotori in "Japan Hardcopy '96", Ronbunshu, p. 153 (1996), Yoshino in "Japan Hardcopy '96", Ronbunshu, p. 157 (1996)). In accordance with a wet-type developing system, by handling toner within a carrier liquid, even if a small particle diameter toner, which is advantageous in obtaining higher image quality, is used, there are advantages as compared with a dry-type developing system, such as dirtying of devices due to the scattering of the toner can be prevented, inhalation of the toner by persons can be prevented, and the like.

However, when a wet-type developing system is used, as described above, in order to aim for higher image quality, a toner of a small particle diameter of 5 $\mu$m or less is usually used. Therefore, the cohesive force between the toner particles is great, and it is easy for problems to arise in the dispersing of the toner. Therefore, problems arise with respect to reliability, such as the storage stability is poor, the image quality is poor, and the like.

Accordingly, currently, there is the strong demand for the development of a toner for a liquid developer which can achieve a reduction in the cohesive force between the toner particles, an improvement in dispersability, and the like.

SUMMARY OF THE INVENTION

An object of the present invention is to provide a toner for a liquid developer which has low cohesive force and excellent dispersion stability and storage stability and which enables formation of high-quality images and is highly reliable, and to provide a liquid developer which uses the toner for a liquid developer and which has low cohesive force and excellent dispersion stability and storage stability and which enables formation of high-quality images and is highly reliable, and to provide an image forming device and image forming method which enable formation of high-quality images.

The toner for a liquid developer of the present invention comprises an epoxy compound whose epoxy equivalent weight is 1000 or less.

The liquid developer of the present invention comprises the toner for a liquid developer of the present invention.

The image forming device of the present invention comprises an electrostatic latent image carrier; means for forming an electrostatic latent image on the electrostatic latent image carrier; means for developing the electrostatic latent image with a liquid developer, forming a visible image, and which accommodates the liquid developer of the present invention; and means for transferring the visible image onto a transfer material.

Because the toner for a liquid developer of the present invention contains an epoxy compound whose epoxy equivalent weight is 1000 or less, when the toner for a liquid developer is used in a liquid developer, the cohesive force is low, and the dispersion stability and storage stability are excellent. Thus, high-quality images can be formed, and the reliability is high.

Because the liquid developer of the present invention comprises the toner for a liquid developer, the cohesive force is low, and the dispersion stability and storage stability are excellent. Thus, high-quality images can be formed, and the reliability is high.

In the image forming device of the present invention, the means for forming an electrostatic latent image forms an electrostatic latent image on the electrostatic latent image carrier. The means for developing develops the electrostatic latent image with a liquid developer, forms a visible image, and accommodates the liquid developer. The means for transferring transfers the visible image onto a transfer material. As a result, a high-quality image can be formed on the transfer material.

DESCRIPTION OF THE PREFERRED EMBODIMENTS (Toner for Liquid Developer)

The toner for a liquid developer of the present invention comprises an epoxy compound whose epoxy equivalent weight is 1000 or less, and contains a binder resin, a colorant, and, if needed, other components.

Epoxy Compound

The epoxy compound is not particularly limited provided that the epoxy equivalent weight thereof is 1000 or less, and can be appropriately selected from among known epoxy compounds. However, from the standpoint of efficiently obtaining a toner for a liquid developer which has good toner characteristics such as developing characteristic, fixing characteristic, transfer characteristic, and the like, suitable examples are bisphenol A epoxy resin, novolak epoxy resin, bisphenol F epoxy resin, brominated epoxy resin, biphenyl epoxy resin, isocyanate-modified epoxy resin, naphthalene epoxy resin, dicyclo epoxy resin, and the like. A single one of these epoxy resins may be used, or two or more may be used in combination.

The epoxy equivalent weight cannot be stipulated unconditionally because the preferable value thereof differs in accordance with the mode of usage, the mode of storage and the like of the toner for a liquid developer. However, a lower epoxy equivalent weight is more preferable from the standpoints of low cohesive force, excellent dispersion stability, and excellent storage stability.

The cohesive force, dispersability and storage stability can be evaluated by carrying out a storage test in which the toner for a liquid developer is left to stand under predetermined conditions (e.g., 50° C. for 24 hours), and by measuring/computing the rate of change in the weight average particle diameter before and after being left to stand and the change in the yield value of the viscosity before and after being left to stand.

Figure 1:
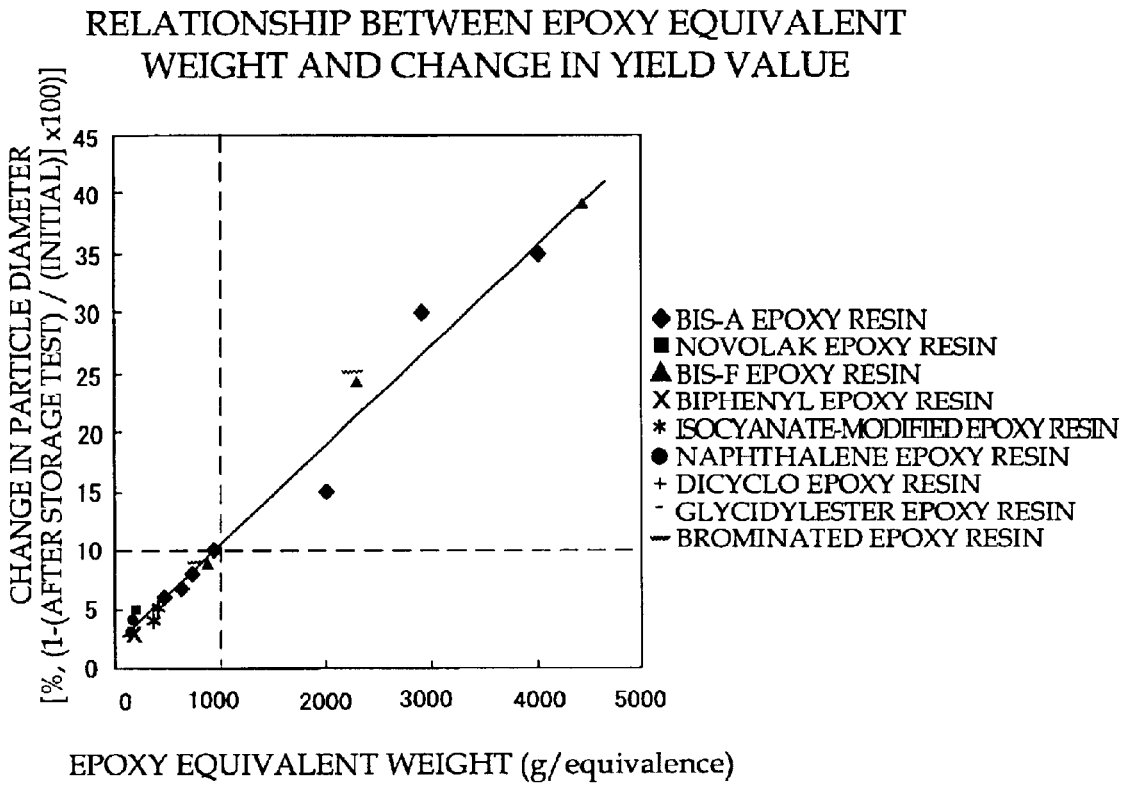
FIG. 1 is a graph showing the relationship between epoxy equivalent weights in toners for a liquid developer in which various types of epoxy compounds are compounded, and rates of change in a weight average particle diameter before and after the toners are left to stand in a storage test.
Figure 2:
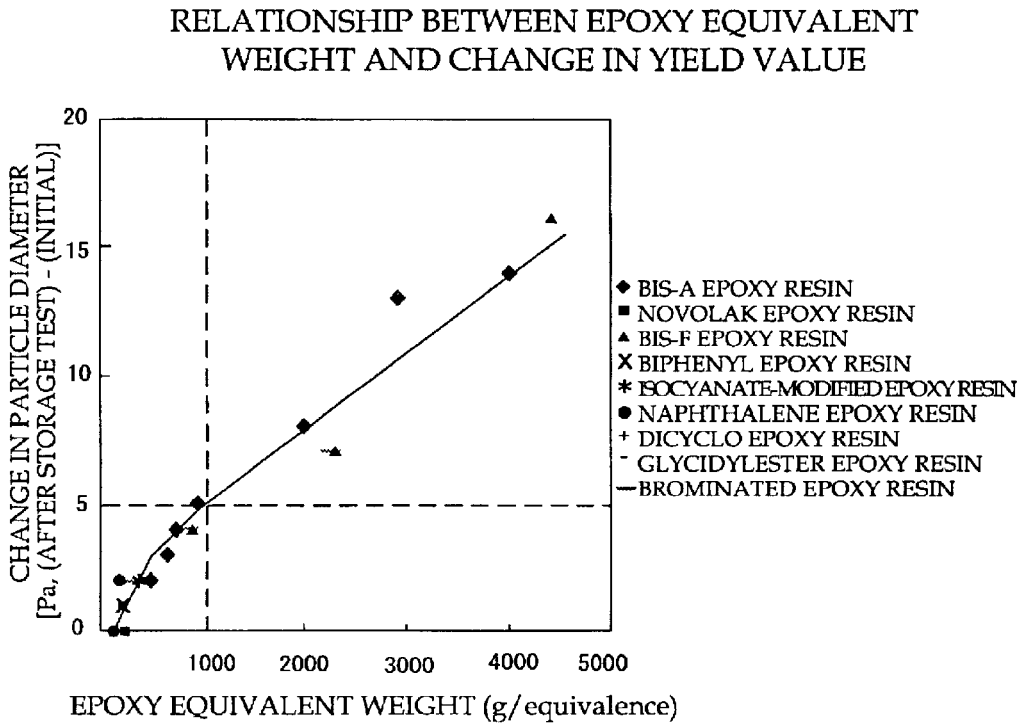
FIG. 2 is a graph showing the relationship between epoxy equivalent weights in toners for a liquid developer in which various types of epoxy compounds are compounded, and changes in a yield value of viscosity before and after the toners are left to stand in a storage test.

FIG. 1 is a graph showing the relationship between the epoxy equivalent weights in toners for a liquid developer in which various types of epoxy compounds are compounded, and rates of change in the weight average particle diameter before and after the toners are left to stand in the storage test (50° C. for 24 hours). FIG. 2 is a graph showing the relationship between the epoxy equivalent weights in toners for a liquid developer in which various types of epoxy compounds are compounded, and changes in the yield value of viscosity before and after the toners are left to stand in the storage test. As can be seen from FIGS. 1 and 2, the smaller the epoxy equivalent weights of the epoxy compounds, the smaller the change in the weight average particle diameter and the change in the yield value of the viscosity due to the storage test (50° C. for 24 hours). This is thought to be because the smaller the epoxy equivalent weight of the epoxy compound, the higher the affinity between the epoxy groups and the carrier liquid contained in the liquid developer, and as the concentration of epoxy groups in the toner for a liquid developer increases, the wettability of the surface of the toner for a liquid developer improves.

In a case in which, in the measurement of the weight average particle diameter, the change in particle diameter before and after the toner is left to stand is 10% or less, and, in the measurement of the yield value of the viscosity, the change in the yield value of the viscosity before and after the toner is left to stand is 5 Pa or less, i.e., in FIGS. 1 and 2, in a case in which the epoxy equivalent weight of the epoxy compound is 1000 or less, a toner for a liquid developer which has low cohesive force and excellent dispersability and storage stability can be obtained.

The weight average particle diameter was measured by using a light-blocking method particle diameter measuring device (CIS-1, manufactured by Galai, Ltd.). Further, the yield value of the viscosity was measured under the following measurement conditions by using a viscoelasticity measuring device (ARES 100FRT, manufactured by Rheometric Scientific, Inc.). Namely, the measuring conditions were such that a COUETE (cup diameter 27 mm, bob diameter 25 mm, bob length 32 mm) was used as the measurement jig, and as the measurement material, 5 g of the toner for a liquid developer was measured out and placed in the cup, and the measurement frequency was set to 6.28 rad/s, the measurement temperature was set to 25° C., the measurement strain was set to an initial value of 700%, and measurement was carried out by using the automatic measurement mode.

Binder Resin

The binder resin is not particularly limited, and can be appropriately selected from among known binder resins. Examples include synthetic resins such as polyester resins, styrene resins, acrylic resins, styrene-acrylic resins, epoxy resins, phenol resins, silicone resins, olefin resins, polyamide resins, petroleum resins, ethylene-methacrylate copolymers, and the like, and natural resins, and the like.

A single binder resin may be used, or two or more types may be used in combination. Further, a linear resin, a resin containing a crosslinking component, or the like, may be appropriately mixed together with the binder resin or binder resins.

Colorant

The colorant is not particular limited, and can be appropriately selected from among known colorants. Examples include pigments, dyes, and the like.

Examples of pigments are carbon, phthalocyanine pigments, benzoimidazolone pigments, arylamide acetoacetate monoazo pigments, arylamide acetoacetate diazo pigments, quinacridone pigments, and the like.

Examples of dyes are azine dyes such as nigrosine, chromium dyes such as chromium salicylate complex, and the like.

A single colorant may be used, or two or more may be used in combination.

The amount of the colorant contained in the toner for a liquid developer is preferably 2 to 40% by mass, and more preferably 10 to 20% by mass, in consideration of the image coloring strength, the configurational stability of the toner, the scattering of the toner, and the like.

Other Components

The other components are not particularly limited, and can be appropriately selected in accordance with the object thereof. Examples are internal additives such as waxes, charge controlling agents, magnetic bodies, and the like. Further, when the toner for a liquid developer is used in a printer using a flash fixing-type system, an infrared absorbent which absorbs light of the infrared region can be suitably used as one of these other components.

The waxes are not particularly limited and may be appropriately selected from among known waxes. Examples include paraffin compounds, polyolefin resins, low molecular weight polypropylene, low molecular weight polyester resins, ester compounds, urethane compounds, polyvinyl pyrrolidone resins, sulfonic acid amide resins, polyethylene resins, microcrystalline wax, and the like. One type of wax, or two or more types of waxes may be used.

The dispersion diameter of the wax is not particularly limited. When the wax is mixed together with the binder resin, the dispersion diameter in the toner for a liquid developer is preferably 5 $\mu$m or less, and more preferably 1 $\mu$m or less.

The amount of the wax contained in the toner for a liquid developer is preferably 1 to 50% by mass, and more preferably 1 to 20% by mass.

The charge controlling agent is not particularly limited and may be appropriately selected from among known charge controlling agents. Examples include fluorine surfactants; metal-containing dyes such as salicylic acid metal complexes, azo metal compounds and the like; tertiary ammonium salts; azine dyes such as nigrosine and the like; and the like. One type or two or more types of charge controlling agents may be used.

The magnetic bodies are not particularly limited and may be appropriately selected from among known magnetic bodies. Examples include metals, alloys, metal compounds, ferrites, and the like.

Examples of metals include iron, cobalt, nickel, and the like. Examples of alloys include alloys of the aforementioned metals, and the like. Examples of metal compounds include $Fe_3O_4$, $\gamma$-$Fe_2O_3$, cobalt-added oxides and the like. Examples of ferrites are MnZn ferrite, NiZn ferrite, and the like. One type or two or more types of these substances may be used.

The infrared absorbent is not particularly limited and may be appropriately selected from among known infrared absorbents. However, infrared absorbents absorbing light of wavelengths of 800 to 1500 nm are suitably used. Specific examples include organic diimonium compounds, naphthalocyanine compounds, aminium compounds, inorganic tin oxide, indium compounds, and the like. A single type of infrared absorbent may be used, or two or more types may be used together. Among these infrared absorbents, doped tin oxide, doped indium oxide, and mixtures thereof are particularly preferable.

The dopant which can suitably dope these metal oxides and the like is not particularly limited, and a suitable dopant can be appropriately selected from among general substances. Specific examples include phosphor, tin, and the like.

The toner for a liquid developer particularly preferably is in the form of particles, from the standpoints of dispersability, uniformity, ease of manufacture, and the like.

When the toner for a liquid developer is in the form of particles, the particle diameter thereof is preferably, as the weight average particle diameter, 20 $\mu$m or less, and more preferably 10 $\mu$m or less.

Manufacturing and the Like of the Toner for a Liquid Developer

The method of manufacturing the toner for a liquid developer is not particularly limited and can be appropriately selected from among known methods. Examples include a mechanical grinding method in which a toner kneaded substance, in which the respective added components such as the colorant and the like have been dispersed in the binder resin, is ground and classified; a polymerizing method in which fine particles are manufactured by polymerizing monomers while taking-in the colorant; and the like.

Examples of mechanical grinding methods include methods of grinding by using a jet mill grinder, a hammer mill grinder, a cutter mill grinder, or the like, methods of grinding by using a sand mill, an attritor, a ball mill, a roll mill, or the like, and the like. Among these methods, a method of grinding by using a sand mill is preferable from the standpoint of manufacturing costs and the like. Hereinafter, an example of manufacturing the toner for a liquid developer by using a method of grinding using a sand mill (a sand mill grinding method) will be described.

In the sand mill grinding method, for example, after the respective components have been mixed together and a mixture obtained, the mixture is melted and kneaded, is cooled and solidified, and thereafter, is ground.

The mixing together is preferably carried out by measuring out the binder resin, the colorant, the charge controlling agent, the wax and the like, and uniformly mixing them together by using a powder mixer. Examples of the powder mixer are a Henschel mixer, a ball mill, and the like.

In order to increase the dispersability of the colorant and to improve the saturation of the color in the finally obtained image, at the time of mixing together the respective components, a master batch, in which the colorant is dispersed in advance in the binder resin at a high concentration, may be used as the colorant. The method of preparing the master batch is not particularly limited, and a flashing method or the like may be used. When a master batch is used, the dispersion concentration of the colorant in the binder resin is preferably 10 to 60% by mass.

The melting and kneading is preferably carried out by placing the mixture in a beaker or the like, and heating and melting and mixing together the mixture. The melting and kneading is preferably carried out by kneading by using a screw extruder, a roll mill, a kneader, or the like. The colorant, the wax, and the various additives can be uniformly dispersed by this melting and kneading.

The cooling and solidifying is preferably carried out by, after the melting and kneading has been completed, cooling and solidifying the obtained kneaded substance. The temperature of the cooling is not particularly limited provided that it is a temperature at which solidification is possible.

The grinding is preferably carried out by first coarsely grinding the kneaded substance, which has been cooled and solidified, to a size of about 1 mm by using a coarse grinder such as a hammer mill, a cutter mill or the like, and then mixing this together in a predetermined concentration with a carrier oil or the like, and carrying out fine grinding by using a DYNO-Mill grinder (manufactured by WAB AG) or the like.

Liquid Developer

The liquid developer, in which the toner for a liquid developer of the present invention is used, includes a carrier liquid in addition to the toner for a liquid developer.

The carrier liquid is not particularly limited and may be appropriately selected from among known carrier liquids. However, a carrier liquid in which the toner for a liquid developer can be dispersed well is preferable. Examples include aliphatic hydrocarbons, silicone oils, vegetable oils, synthetic oils, and the like.

Examples of aliphatic hydrocarbons are isododecane, isoparaffin, normal paraffin, and the like.

Examples of silicone oils are dimethyl silicone, methylphenyl silicone, cyclic dimethyl polysiloxane, fluorosilicone, and the like.

The silicone oil is not particularly limited, and can be appropriately selected from among known silicone oils. An example is dimethyl silicone oil which can be obtained inexpensively, is water-resistant, solvent-resistant, and the like. Using the silicone oil together with, as a reactive compound, a reactive silicone compound which has a polysiloxane skeleton is preferable from the standpoint of improving the dispersion stability of the toner for a liquid developer.

The vegetable oil is not particularly limited and may be appropriately selected from among known vegetable oils. Examples include soybean oil, safflower oil, sunflower oil, castor oil, linseed oil, olive oil, and the like.

The synthetic oil is not particularly limited and may be appropriately selected from among known synthetic oils. Examples include fatty acid esters obtained from reaction of higher fatty acids and alcohols; esterification products generated from higher fatty acids and ethylene glycol or glycerine; and the like.

A single one of these carrier liquids may be used, or two or more types may be used.

Specific examples of commercially-available carrier liquids include, as aliphatic hydrocarbons, ISOPAR-G, H, L, M, V (manufactured by ExxonMobil Chemical Company), NORPAR-12 (manufactured by ExxonMobil Chemical Company), and the like, and as silicone oils, SH-200 series (manufactured by Toray Dow Corning Silicone Co., Ltd.), KF-96 series (manufactured by Shin-Etsu Chemical Co., Ltd.), L-45 series (manufactured by Nihonunica Corporation), AK series (manufactured by Wacker Asahikasei Silicone Co., Ltd.), and the like.

For the purposes of decreasing the cohesive force between the particles of the toner for a liquid developer, and improving the dispersability, adjusting the charge, and adjusting the viscosity of the toner for a liquid developer, and the like, the carrier liquid preferably contains a reactive compound such as follows.

From the standpoint of being able to improve the state of dispersion of the toner for a liquid developer, the reactive compound preferably has at least one group selected from amino groups, isocyanate groups, carboxyl groups, mercapto groups, epoxy groups, vinyl groups, and hydroxyl groups. A single type of reactive compound may be used, or two or more types of reactive compounds may be used.

From the standpoint of being able to improve the dispersability of the toner for a liquid developer, the reactive compound preferably has a siloxane structure.

The carrier liquid may contain a metallic soap such as a metallic salt of octylic acid, a metallic salt of naphthenic acid, or the like, as well as a charge adjusting agent such as a titanium organic compound, an aluminum organic compound, or the like. In addition, the carrier liquid may contain a surfactant such as a higher fatty acid derivative, a polyetheresterate derivative, a polyesterate derivative, a polycarbonate derivative, or the like; solid particulates which are insoluble in the carrier liquid such as silica particulates, alumina particulates, titania particulates, and the like; or the like.

The contained amount of these substances in the carrier liquid is preferably 0.1 to 10% by mass, and more preferably 0.5 to 2% by mass.

The toner for a liquid developer of the present invention may be any of a black toner, a magenta toner, a yellow toner, a cyan toner, or the like.

The toner for a liquid developer of the present invention can be manufactured by a known method of manufacturing a toner for a liquid developer.

The toner for a liquid developer of the present invention is suited to use in various fields, and is suited to liquid developers, image forming methods, and image forming devices using an electrophotographic method. The toner for a liquid developer of the present invention is particularly suited to the liquid developer, image forming device and image forming method of the present invention which will be described hereinafter.

(Liquid Developer)

The liquid developer of the present invention contains at least the toner for a liquid developer of the present invention, and contains the carrier liquid which was described above.

The method of manufacturing the liquid developer is as described above. Examples include the aforementioned mechanical grinding methods, the aforementioned polymerization methods, and the like. The above-described sand mill grinding method is preferable.

Because the liquid developer of the present invention contains the toner for a liquid developer of the present invention, the cohesive force is low, the dispersion stability and storage stability are excellent, and high-quality images can be formed.

The liquid developer of the present invention can suitably be used in image formation in accordance with an electrophotographic method, and is particularly suitably used in the image forming method and image forming device of the present invention which will be described hereinafter.

(Image Forming Method and Image Forming Device)

The image forming method of the present invention includes at least a step for forming an electrostatic latent image, a step for developing, and a step for transferring. The image forming method preferably further includes a step for fixing, and may, as needed, include other steps which have been appropriately selected, such as a step for eliminating charges, a step for cleaning, a step for recycling, a step for controlling, and the like.

The image forming device of the present invention includes at least an electrostatic latent image carrier, means for forming an electrostatic latent image, means for developing and means for transferring. The image forming device preferably further includes means for fixing, and may, as needed, include other means which have been appropriately selected, such as a means for eliminating charges, a means for cleaning, a means for recycling, means for controlling, and the like.

The image forming method of the present invention can suitably be implemented by the image forming device of the present invention. The step for forming an electrostatic latent image can be carried out by the means for forming an electrostatic latent image, the step for developing can be carried out by the means for developing, the step for transferring can be carried out by the means for transferring, the step for fixing can be carried out by the means for fixing, and the other steps can be carried out by the other means.

Step for Forming Electrostatic Latent Image and Means for Forming Electrostatic Latent Image The step for forming an electrostatic latent image is a step of forming an electrostatic latent image on an electrostatic latent image carrier.

The material, configuration, structure, size and the like of the electrostatic latent image carrier (which hereinafter may be called "photoconductive insulator" or "photoconductor") are not particularly limited, and the electrostatic latent image carrier may be appropriately selected from among known ones. However, drum-shaped is a suitable example of the configuration thereof, and inorganic photosensitive bodies of amorphous silicone, selenium, and the like, and organic photosensitive bodies of polysilane, phthalocyanine, and the like, and the like are examples of the material thereof.

The electrostatic latent image can be formed, for example, by uniformly charging the surface of the electrostatic latent image carrier, and thereafter, carrying out image-wise exposure. The electrostatic latent image can be formed by the means for forming an electrostatic latent image.

The means for forming an electrostatic latent image includes at least a charging device which uniformly charges the surface of the electrostatic latent image carrier, and an exposure device which image-wise exposes the surface of the electrostatic latent image carrier.

The charging can be carried out by, for example, applying voltage to the surface of the electrostatic latent image carrier by using the charging device.

The charging device is not particularly limited and may be appropriately selected in accordance with the object. Examples of the charging device include known contact-type charging devices equipped with conductive or semi-conductive rollers, brushes, films, rubber blades, and the like; non-contact-type charging devices utilizing corona discharge such as a corotron, a scorotron, and the like; and the like.

The exposure can be carried out by, for example, image-wise exposing the surface of the electrostatic latent image carrier by using the exposure device.

Provided that the exposure device can expose the image to be formed on the surface of the electrostatic latent image carrier which has been charged by the charging device, the exposure device is not particularly limited and can be appropriately selected in accordance with the object. Examples include various types of exposure devices such as a reproducing optical system, a rod-lens array system, a laser optical system, a liquid crystal shutter optical system, and the like.

The present invention may use a backlighting system which carries out image-wise exposure from the reverse surface side of the electrostatic latent image carrier.

Step for Developing and Means for Developing

The step for developing is a step of developing the electrostatic latent image by using the liquid developer of the present invention, so as to form a visible image.

The formation of the visible image can be carried out by, for example, developing the electrostatic latent image by using the liquid developer of the present invention, and can be carried out by the means for developing.

The means for developing has at least a developing device which can accommodate the liquid developer of the present invention, and which can apply, by contact or without contact, the liquid developer to the electrostatic latent image.

The developing device is not particularly limited provided that it is a wet-developing method developing device, and may be a developing device for a single color or a developing device for plural colors. An example is a developing device which conveys the liquid developer on the photoconductor by a developing roller formed by a conductive sponge roller or the like, or the like. In this case, the liquid developer may be of a form which can be supplied to the developing roller by developer supplying rollers or the like. In the liquid developer, the toner particles which carry charges are suspended in the insulating carrier liquid. The toner particles move to the surface of the electrostatic latent image carrier (the photoconductor) by electrostatic attraction with the electrostatic latent image. As a result, the electrostatic latent image is developed by the toner particles, and a visible image made visible by the toner particles is formed on the surface of the electrostatic latent image carrier (photoconductor).

In the case of single-color development, generally, black toner is used as the toner for a liquid developer contained in the liquid developer. In the case of multi-color development, toners of at least two colors selected from black toner, magenta toner, yellow toner, and cyan toner are used. In the case of full-color development, black toner, magenta toner, yellow toner and cyan toner are used.

Step for Transferring and Means for Transferring

The step for transferring is a step of transferring the visible image to a transfer material.

This transfer can be carried out, for example, by utilizing a transfer charging device of a polarity opposite to the polarity of the toner for a liquid developer contained in the liquid developer, and can be carried out by the means for transferring.

The means for transferring has at least a transfer device which can peel-charge the visible image formed on the electrostatic latent image carrier (the photoconductor) onto a transfer material.

Examples of the transfer device include a corona transfer device carrying out transfer by corona discharge, a transfer belt, a transfer roller, a pressure-transfer roller, an adhesion transfer device, and the like.

The transfer material is not particularly limited, and may be appropriately selected from among known recording media (recording papers).

Step for Fixing and Means for Fixing

The step for fixing is a step of fixing, by using a fixing device, the transfer image which has been transferred onto the transfer material.

Examples of the fixing are a flash fixing method, and a heating/pressurizing fixing method carried out by using a heat-fixing roller on the transfer image which has been transferred onto the transfer material. The fixing can be carried out by the means for fixing.

The flash fixing may be carried out by, for example, irradiating light, by using a flash fixing device, onto the transfer image which has been transferred onto the transfer material. The flash fixing can be carried out by a means for flash fixing.

The means for flash fixing has at least a flash lamp which irradiates infrared light.

The flash lamp is not particularly limited, and may be appropriately selected in accordance with the object. Suitable examples include an infrared ray lamp, a xenon lamp, and the like.

The step for eliminating charges is a step of carrying out charge elimination by exposing the entire surface of the electrostatic latent image carrier or applying a charge-eliminating bias to the electrostatic latent image carrier. The step for eliminating charges can be suitably carried out by a means for eliminating charges.

The means for eliminating charges is not particularly limited, and can be appropriately selected from among known charge eliminating devices, provided that it can expose or can apply a charge-eliminating bias to the electrostatic latent image carrier.

The step for cleaning is a step of removing the electrophotographic toner remaining on the electrostatic latent image carrier, and can be suitably carried out by a means for cleaning.

The means for cleaning is not particularly limited, and can be selected from known cleaners provided that it can remove the electrophotographic toner remaining on the electrostatic latent image carrier. Suitable examples of the means for cleaning include a magnetic brush cleaner, an electrostatic brush cleaner, a magnetic roller cleaner, a blade cleaner, a brush cleaner, a web cleaner, and the like.

The step for recycling is a step of recycling, to the means for developing, the toner for a liquid developer which has been removed by the step for cleaning, and can be suitably carried out by a means for recycling.

The means for recycling is not particularly limited, and known means for conveying and the like are examples thereof.

The means for controlling is not particularly limited provided that it can control the workings of the above-described respective means, and can be appropriately selected in accordance with the object. Examples include devices such as a sequencer, a computer, and the like.

In the image forming method of the present invention, the electrostatic latent image is formed on the electrostatic latent image carrier in the step for forming an electrostatic latent image. In the step for developing, the electrostatic latent image is developed by the liquid developer of the present invention such that a visible image is formed. In the step for transferring, the visible image is transferred onto a transfer material. In the step for fixing, the transfer image, which has been transferred onto the transfer material, is fixed. As a result, an image is formed on the transfer material. Thus, an image can be formed and fixed on the transfer material at an extremely high speed.

In the image forming device of the present invention, the means for forming an electrostatic latent image forms an electrostatic latent image on an electrostatic latent image carrier. The means for developing accommodates the liquid developer of the present invention, and develops the electrostatic latent image so as to form a visible image. The means for transferring transfers the visible image onto a transfer material. The means for fixing fixes the transfer image which has been transferred onto the transfer material. As a result, an image is formed and fixed on the transfer material at an extremely high speed.

The liquid developer of the present invention, which contains the toner for a liquid developer of the present invention, is used as the liquid developer in the image forming device and the image forming method. Thus, high-quality images can be formed.

Hereinafter, Examples of the present invention and Comparative Examples will be described. However, the present invention is not in any way limited to the following Examples. Details of the components which are compounded in the preparation of the toners for a liquid developer of the Examples and Comparative Examples are shown in Tables 1, 2 and 4.

EXAMPLE 1

Preparation of Liquid Developer 40 parts by mass of a Bis-A epoxy resin (epoxy equivalent weight=2000, EPIKOTE 1007, manufactured by Japan Epoxy Resins Co., Ltd. (hereinafter abbreviated as "JER") as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion and 80 parts by mass of a silicone oil (SH200 20 cst, manufactured by Toray Dow Corning Silicone Co., Ltd.) as the carrier liquid (carrier oil) was mixed together. By using a bead mill grinder (DYNO-Mill, manufactured by WAB AG), the toner solid portion was finely ground in the carrier liquid, so as to prepare the liquid developer of Example 1 which contained the toner for a liquid developer within the carrier liquid.

The obtained liquid developer was left to stand for 24 hours at 50° C. The weight average particle diameter and the yield value of the viscosity before and after the liquid developer was left to stand were respectively measured as follows. The evaluations of the cohesiveness, dispersability, and storage stability of the toner for a liquid developer contained in the liquid developer were thereby carried out.

Namely, the weight average particle diameter was measured by using a light-blocking method particle diameter measuring device (CIS-1, manufactured by Galai, Ltd.). Further, the yield value of the viscosity was measured under the following measurement conditions by using a viscoelasticity measuring device (ARES 100FRT, manufactured by Rheometric Scientific, Inc.). Namely, the measuring conditions were such that a COUETE (cup diameter 27 mm, bob diameter 25 mm, bob length 32 mm) was used as the measurement jig. As the measurement material, 5 g of the toner for a developer was measured out and placed in the cup, and the measurement frequency was set to 6.28 rad/s, the measurement temperature was set to 25° C., the measurement strain was set to an initial value of 700%, and measurement was carried out by using the automatic measurement mode.

In a case in which, in the measurement of the weight average particle diameter, the rate of change in the particle diameter before and after the liquid developer was left to stand, which is expressed by the formula rate of change in particle diameter (%)=(1−(particle diameter after storage test)/(particle diameter before storage test))×100, was 10% or less and, in the measurement of the yield value of the viscosity, the change in the yield value of the viscosity before and after the liquid developer was left to stand was 5 Pa or less, the evaluation was given that the toner for a liquid developer had low cohesiveness and excellent dispersability and storage stability. The results are shown in Table 3.

Image Formation

The liquid developer before the storability test and the liquid developer after the storability test at 75° were used in an image forming device 100 shown in FIG. 3, and images were formed as follows. Namely, in the image forming device 100 shown in FIG. 3, first, an electrostatic latent image was formed by a charging device 2 and an exposure device 3 on a photoconductor 1 which rotated in the direction of the arrow. By supplying the liquid developer from developer supplying rollers 4 to a developing roller 5, a thin layer of the supplied liquid developer was formed on the developing roller 5 such that a developer layer was formed. Due to the photoconductor 1 rotating further in the direction of the arrow, the electrostatic latent image formed on the photoconductor 1 was made to contact the developer layer formed on the developing roller 5, and a visible image was formed by the toner particles contained in the liquid developer. The formed visible image was transferred onto a recording paper 10 by a pressure-applying roller 9 and was fixed by an unillustrated fixing roller such that a transfer image was formed.

Figure 3:
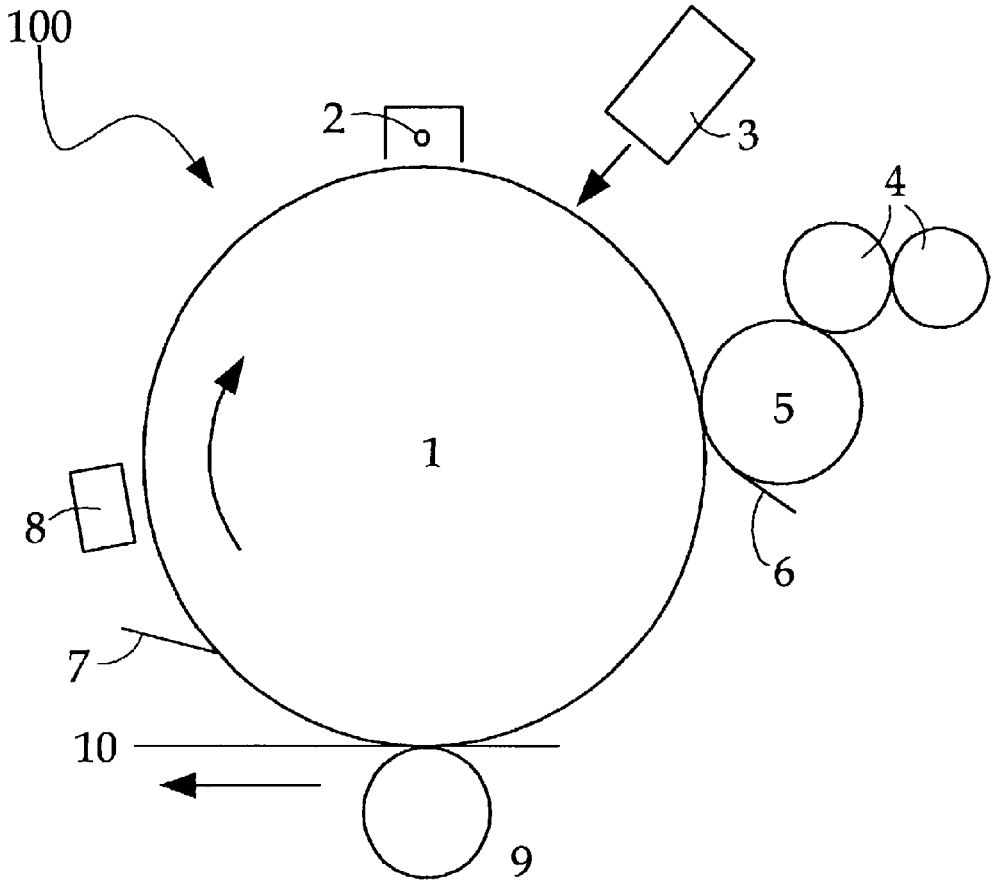
FIG. 3 is a schematic structural diagram of an image forming device 100 suitably used in the present invention.

After image formation, when the obtained transfer image was evaluated by using the prototype printer shown in FIG. 3, it was confirmed that a high-quality image was obtained.

EXAMPLE 2

A liquid developer was manufactured in the same way as in Example 1, except that the epoxy compound in Example 1 was changed to a Bis-A epoxy resin (epoxy equivalent weight=650, EPIKOTE 1002, manufactured by JER). The same evaluations as those in Example 1 were carried out, and the results thereof are shown in Table 3. In the same way as in Example 1, a high-quality image was obtained.

EXAMPLE 3

A liquid developer was manufactured in the same way as in Example 1, except that the epoxy compound in Example 1 was changed to a Bis-A epoxy resin (epoxy equivalent weight=730, EPIKOTE 1003, manufactured by JER). The same evaluations as those in Example 1 were carried out, and the results thereof are shown in Table 3. In the same way as in Example 1, a high-quality image was obtained.

EXAMPLE 4

A liquid developer was manufactured in the same way as in Example 1, except that the epoxy compound in Example 1 was changed to a Bis-A epoxy resin (epoxy equivalent weight=950, EPIKOTE 1004, manufactured by JER). The same evaluations as those in Example 1 were carried out, and the results thereof are shown in Table 3. In the same way as in Example 1, a high-quality image was obtained.

COMPARATIVE EXAMPLE 1

A liquid developer was manufactured in the same way as in Example 1, except that the epoxy compound in Example 1 was changed to a Bis-A epoxy resin (epoxy equivalent weight=2000, EPIKOTE 1007, manufactured by JER). The same evaluations as those in Example 1 were carried out, and the results thereof are shown in Table 3. As compared with Example 1, a deterioration in image quality was observed.

COMPARATIVE EXAMPLE 2

A liquid developer was manufactured in the same way as in Example 1, except that the epoxy compound in Example 1 was changed to a Bis-A epoxy resin (epoxy equivalent weight=2900, EPIKOTE 1009, manufactured by JER). The same evaluations as those in Example 1 were carried out, and the results thereof are shown in Table 3. As compared with Example 1, a deterioration in image quality was observed.

COMPARATIVE EXAMPLE 3

A liquid developer was manufactured in the same way as in Example 1, except that the epoxy compound in Example 1 was changed to a Bis-A epoxy resin (epoxy equivalent weight=4000, EPIKOTE 1010, manufactured by JER). The same evaluations as those in Example 1 were carried out, and the results thereof are shown in Table 3. As compared with Example 1, a deterioration in image quality was observed.

EXAMPLE 5

A liquid developer was manufactured in the same way as in Example 1, except that the epoxy compound in Example 1 was changed to a novolak epoxy resin (epoxy equivalent weight=175, EPIKOTE 154, manufactured by JER). The same evaluations as those in Example 1 were carried out, and the results thereof are shown in Table 3. In the same way as in Example 1, a high-quality image was obtained.

EXAMPLE 6

A liquid developer was manufactured in the same way as in Example 1, except that the epoxy compound in Example 1 was changed to a novolak epoxy resin (epoxy equivalent weight=210, EPIKOTE 180S65, manufactured by JER). The same evaluations as those in Example 1 were carried out, and the results thereof are shown in Table 3. In the same way as in Example 1, a high-quality image was obtained.

EXAMPLE 7

A liquid developer was manufactured in the same way as in Example 1, except that the epoxy compound in Example 1 was changed to a novolak epoxy resin (epoxy equivalent weight=210, N-660, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 8

A liquid developer was manufactured in the same way as in Example 1, except that the epoxy compound in Example 1 was changed to a novolak epoxy resin (epoxy equivalent weight=215, N-670, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 9

A liquid developer was manufactured in the same way as in Example 1, except that the epoxy compound in Example 1 was changed to a novolak epoxy resin (epoxy equivalent weight=215, N-680, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 10

A liquid developer was manufactured in the same way as in Example 1, except that the epoxy compound in Example 1 was changed to a novolak epoxy resin (epoxy equivalent weight=190, N-770, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 11

A liquid developer was manufactured in the same way as in Example 1, except that the epoxy compound in Example 1 was changed to a novolak epoxy resin (epoxy equivalent weight=190, N-775, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 12

A liquid developer was manufactured in the same way as in Example 1, except that the epoxy compound in Example 1 was changed to a Bis-F epoxy resin (epoxy equivalent weight=880, EPIKOTE 4004, manufactured by JER). The same evaluations as those in Example 1 were carried out, and the results thereof are shown in Table 3. In the same way as in Example 1, a high-quality image was obtained.

COMPARATIVE EXAMPLE 4

A liquid developer was manufactured in the same way as in Example 1, except that the epoxy compound in Example 1 was changed to a Bis-F epoxy resin (epoxy equivalent weight=2270, EPIKOTE 4007P, manufactured by JER). The same evaluations as those in Example 1 were carried out, and the results thereof are shown in Table 3. As compared with Example 1, a deterioration in image quality was observed.

COMPARATIVE EXAMPLE 5

A liquid developer was manufactured in the same way as in Example 1, except that the epoxy compound in Example 1 was changed to a Bis-F epoxy resin (epoxy equivalent weight=4400, EPIKOTE 4010P, manufactured by JER). The same evaluations as those in Example 1 were carried out, and the results thereof are shown in Table 3. As compared with Example 1, a deterioration in image quality was observed.

EXAMPLE 13

A liquid developer was manufactured in the same way as in Example 1, except that the epoxy compound in Example 1 was changed to a biphenyl epoxy resin (epoxy equivalent weight=186, EPIKOTE YX4000, manufactured by JER). The same evaluations as those in Example 1 were carried out, and the results thereof are shown in Table 3. In the same way as in Example 1, a high-quality image was obtained.

EXAMPLE 14

A liquid developer was manufactured in the same way as in Example 1, except that the epoxy compound in Example 1 was changed to a biphenyl epoxy resin (epoxy equivalent weight=193, EPIKOTE YX4000H, manufactured by JER). The same evaluations as those in Example 1 were carried out, and the results thereof are shown in Table 3. In the same way as in Example 1, a high-quality image was obtained.

EXAMPLE 15

A liquid developer was manufactured in the same way as in Example 1, except that the epoxy compound in Example 1 was changed to an isocyanate-modified epoxy resin (epoxy equivalent weight=410, EXA-4700, manufactured by Asahi Chemical Epoxy Co., Ltd.). The same evaluations as those in Example 1 were carried out, and the results thereof are shown in Table 3. In the same way as in Example 1, a high-quality image was obtained.

EXAMPLE 16

A liquid developer was manufactured in the same way as in Example 1, except that the epoxy compound in Example 1 was changed to an isocyanate-modified epoxy resin (epoxy equivalent weight=345, 4152, manufactured by Asahi Chemical Epoxy Co., Ltd.). The same evaluations as those in Example 1 were carried out, and the results thereof are shown in Table 3. In the same way as in Example 1, a high-quality image was obtained.

EXAMPLE 17

A liquid developer was manufactured in the same way as in Example 1, except that the epoxy compound in Example 1 was changed to a naphthalene epoxy resin (epoxy equivalent weight=145, EXA-4700, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 18

A liquid developer was manufactured in the same way as in Example 1, except that the epoxy compound in Example 1 was changed to a naphthalene epoxy resin (epoxy equivalent weight=162, HP-4032, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 19

A liquid developer was manufactured in the same way as in Example 1, except that the epoxy compound in Example 1 was changed to a dicyclo epoxy resin (epoxy equivalent weight=260, HP-7200, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 20

A liquid developer was manufactured in the same way as in Example 1, except that the epoxy compound in Example 1 was changed to a dicyclo epoxy resin (epoxy equivalent weight=260, HP-7200H, manufactured by Dainippon Ink & Chemicals, Inc.). The same evaluations as those in Example 1 were carried out, and the results thereof are shown in Table 3. In the same way as in Example 1, a high-quality image was obtained.

EXAMPLE 21

A liquid developer was manufactured in the same way as in Example 1, except that the epoxy compound in Example 1 was changed to a glycidylester epoxy resin (epoxy equivalent weight=170, EPIKOTE 191P, manufactured by JER). The same evaluations as those in Example 1 were carried out, and the results thereof are shown in Table 3. In the same way as in Example 1, a high-quality image was obtained.

EXAMPLE 22

A liquid developer was manufactured in the same way as in Example 1, except that the epoxy compound in Example 1 was changed to a brominated epoxy resin (epoxy equivalent weight=800, EPIKOTE 5054, manufactured by JER). The same evaluations as those in Example 1 were carried out, and the results thereof are shown in Table 3. In the same way as in Example 1, a high-quality image was obtained.

COMPARATIVE EXAMPLE 6

A liquid developer was manufactured in the same way as in Example 1, except that the epoxy compound in Example 1 was changed to a brominated epoxy resin (epoxy equivalent weight=2250, EPIKOTE 5057, manufactured by JER). The same evaluations as those in Example 1 were carried out, and the results thereof are shown in Table 3. As compared with Example 1, a deterioration in image quality was observed.

TABLE 1

| | epoxy compound | | | | carrier liquid | |
|---|---|---|---|---|---|---|
| ex. no. | structure | type no. | manufacturer | epoxy equivalent weight | carrier oil | reactive compound |
| ex. 1 | Bis-A epoxy resin | EPIKOTE 1001 | JER | 475 | silicone oil | none |
| ex. 2 | Bis-A epoxy resin | EPIKOTE 1002 | JER | 650 | silicone oil | none |
| ex. 3 | Bis-A epoxy resin | EPIKOTE 1003 | JER | 730 | silicone oil | none |
| ex. 4 | Bis-A epoxy resin | EPIKOTE 1004 | JER | 950 | silicone oil | none |
| comp. ex. 1 | Bis-A epoxy resin | EPIKOTE 1007 | JER | 2000 | silicone oil | none |
| comp. ex. 2 | Bis-A epoxy resin | EPIKOTE 1009 | JER | 2900 | silicone oil | none |
| comp. ex. 3 | Bis-A epoxy resin | EPIKOTE 1010 | JER | 4000 | silicone oil | none |
| ex. 5 | novolak epoxy resin | EPIKOTE 154 | JER | 175 | silicone oil | none |
| ex. 6 | novolak epoxy resin | EPIKOTE 180S65 | JER | 210 | silicone oil | none |
| ex. 7 | novolak epoxy resin | N-660 | Dainippon Ink & Chemicals | 210 | silicone oil | none |
| ex. 8 | novolak epoxy resin | N-670 | Dainippon Ink & Chemicals | 215 | silicone oil | none |
| ex. 9 | novolak epoxy resin | N-680 | Dainippon Ink & Chemicals | 215 | silicone oil | none |
| ex. 10 | novolak epoxy resin | N-770 | Dainippon Ink & Chemicals | 190 | silicone oil | none |
| ex. 11 | novolak epoxy resin | N-775 | Dainippon Ink & Chemicals | 190 | silicone oil | none |
| ex. 12 | Bis-F epoxy resin | EPIKOTE 4004 | JER | 880 | silicone oil | none |
| comp. ex. 4 | Bis-F epoxy resin | EPIKOTE 4010P | JER | 2270 | silicone oil | none |
| comp. ex. 5 | Bis-F epoxy resin | EPIKOTE 4008P | JER | 4400 | silicone oil | none |

TABLE 2

| | epoxy compound | | | | carrier liquid | |
|---|---|---|---|---|---|---|
| ex. no. | structure | type no. | manufacturer | epoxy equivalent weight | carrier oil | reactive compound |
| ex. 13 | biphenyl epoxy resin | EPIKOTE YX4000 | JER | 186 | silicone oil | none |
| ex. 14 | biphenyl epoxy resin | EPIKOTE YX400H | JER | 193 | silicone oil | none |
| ex. 15 | Isocyanate modified epoxy resin | EXA-4700 | Asahi Chemical Epoxy | 345 | silicone oil | none |
| ex. 16 | Isocyanate modified epoxy resin | 4152 | Asahi Chemical Epoxy | 145 | silicone oil | none |
| ex. 17 | naphthalene epoxy resin | EXA-4700 | Dainippon Ink & Chemicals | 145 | silicone oil | none |
| ex. 18 | naphthalene epoxy resin | HP-4032 | Dainippon Ink & Chemicals | 162 | silicone oil | none |
| ex. 19 | dicyclo epoxy resin | HP-7200 | Dainippon Ink & Chemicals | 260 | silicone oil | none |

TABLE 2-continued

| | epoxy compound | | | | carrier liquid | |
|---|---|---|---|---|---|---|
| ex. no. | structure | type no. | manufacturer | epoxy equivalent weight | carrier oil | reactive compound |
| ex. 20 | dicyclo epoxy resin | HP-7200H | Dainippon Ink & Chemicals | 260 | silicone oil | none |
| ex. 21 | glycidyl-ester epoxy resin | EPIKOTE 191P | JER | 170 | silicone oil | none |
| ex. 22 | brominated epoxy resin | EPIKOTE 5054 | JER | 800 | silicone oil | none |
| comp. ex. 6 | brominated epoxy resin | EPIKOTE 5057 | JER | 2250 | silicone oil | none |

TABLE 3

| | initial | | after storage test (50° C., 24 hours) | | degree of change before and after storage test | |
|---|---|---|---|---|---|---|
| toner | weight average particle diameter (μm) | yield value of viscosity (Pa) | weight average particle diameter (μm) | yield value of viscosity (Pa) | rate of change in particle diameter (%) | change in yield value (Pa) |
| ex. 1 | 3.8 | 5 | 4.0 | 7 | 6 | 2 |
| ex. 2 | 3.9 | 5 | 4.2 | 8 | 7 | 3 |
| ex. 3 | 3.9 | 6 | 4.2 | 10 | 8 | 4 |
| ex. 4 | 4 | 7 | 4.4 | 12 | 10 | 5 |
| comp. ex. 1 | 4.1 | 7 | 4.8 | 15 | 15 | 8 |
| comp. ex. 2 | 4.1 | 8 | 5.9 | 21 | 30 | 13 |
| comp. ex. 3 | 4.2 | 9 | 6.5 | 23 | 35 | 14 |
| ex. 5 | 3.7 | 2 | 3.9 | 3 | 4 | 1 |
| ex. 6 | 3.8 | 3 | 4.0 | 4 | 5 | 1 |
| ex. 7 | 3.8 | 3 | 4.0 | 4 | 4 | 1 |
| ex. 8 | 3.8 | 3 | 4.0 | 3 | 4 | 0 |
| ex. 9 | 3.9 | 3 | 4.0 | 4 | 3 | 1 |
| ex. 10 | 3.9 | 3 | 4.1 | 4 | 5 | 1 |
| ex. 11 | 3.8 | 2 | 4.0 | 2 | 4 | 0 |
| ex. 12 | 3.8 | 7 | 4.2 | 11 | 9 | 4 |
| com. ex. 4 | 4.2 | 8 | 5.5 | 15 | 24 | 7 |
| com. ex. 5 | 4.3 | 10 | 7.0 | 26 | 39 | 16 |
| ex. 13 | 3.9 | 3 | 4.0 | 4 | 3 | 1 |
| ex. 14 | 4 | 3 | 4.1 | 4 | 3 | 1 |
| ex. 15 | 3.5 | 5 | 3.7 | 7 | 5 | 2 |
| ex. 16 | 3.6 | 4 | 3.8 | 6 | 4 | 2 |
| ex. 17 | 3.8 | 2 | 3.9 | 2 | 3 | 0 |
| ex. 18 | 3.7 | 2 | 3.9 | 4 | 4 | 2 |
| ex. 19 | 3.8 | 3 | 4.0 | 5 | 5 | 2 |
| ex. 20 | 3.8 | 3 | 4.0 | 5 | 5 | 2 |
| ex. 21 | 3.5 | 3 | 3.6 | 4 | 3 | 1 |
| ex. 22 | 3.7 | 7 | 4.1 | 11 | 9 | 4 |
| comp. ex. 6 | 3.9 | 8 | 5.2 | 15 | 25 | 7 |

EXAMPLE 23

40 parts by mass of a Bis-A epoxy resin (epoxy equivalent weight=2000, EPIKOTE 1007, manufactured by JER) as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion and 80 parts by mass of ISOPAR H (manufactured by ExxonMobil Chemical Company) as the carrier liquid (carrier oil) was mixed together. By using a bead mill grinder (DYNO-Mill, manufactured by WAB AG), the toner solid portion was finely ground in the carrier liquid, so as to prepare the liquid developer of Example 23 which contained the toner for a liquid developer within the carrier liquid.

Using the obtained liquid developer, the same evaluations as those in Example 1 were carried out. The results are shown in Table 5. In the same way as in Example 1, a high-quality image was obtained.

EXAMPLE 24

A liquid developer was manufactured in the same way as in Example 23, except that the epoxy compound in Example 23 was changed to a novolak epoxy resin (epoxy equivalent weight=190, N-775, manufactured by Dainippon Ink & Chemicals, Inc.). The same evaluations as those in Example 23 were carried out, and the results thereof are shown in Table 5. In the same way as in Example 23, a high-quality image was obtained.

EXAMPLE 25

40 parts by mass of a Bis-A epoxy resin (epoxy equivalent weight=2000, EPIKOTE 1007, manufactured by JER) as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion and 80 parts by mass of soybean oil (manufactured by Wako Pure Chemicals Industries, Ltd.) as the carrier liquid (carrier oil) was mixed together. By using a bead mill grinder (DYNO-Mill, manufactured by WAB AG), the toner solid portion was finely ground in the carrier liquid, so as to prepare the liquid developer of Example 25 which contained the toner for a liquid developer within the carrier liquid.

Using the obtained liquid developer, the same evaluations as those in Example 1 were carried out. The results are shown in Table 5. In the same way as in Example 1, a high-quality image was obtained.

EXAMPLE 26

A liquid developer was manufactured in the same way as in Example 25, except that the epoxy compound in Example 25 was changed to a novolak epoxy resin (epoxy equivalent weight=190, N-775, manufactured by Dainippon Ink & Chemicals, Inc.). The same evaluations as those in Example 25 were carried out, and the results thereof are shown in Table 5. In the same way as in Example 25, a high-quality image was obtained.

EXAMPLE 27

40 parts by mass of a Bis-A epoxy resin (epoxy equivalent weight=2000, EPIKOTE 1007, manufactured by JER) as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion, 79 parts by mass of silicone oil (SH200 20 cst, manufactured by Toray Dow Corning Silicone Co., Ltd.) as the carrier liquid (carrier oil), and 1 part by mass of an amino-modified silicone (BY16–872, manufactured by Shin-Etsu Chemical Co., Ltd.) as the reactive compound, was mixed together. By using a bead mill grinder (DYNO-Mill, manufactured by WAB AG), the toner solid portion was finely ground in the carrier liquid, so as to prepare the liquid developer of Example 27 which contained the toner for a liquid developer within the carrier liquid.

Using the obtained liquid developer, the same evaluations as those in Example 1 were carried out. The results are shown in Table 5. In the same way as in Example 1, a high-quality image was obtained.

EXAMPLE 28

A liquid developer was manufactured in the same way as in Example 27, except that the epoxy compound in Example 27 was changed to a novolak epoxy resin (epoxy equivalent weight=190, N-775, manufactured by Dainippon Ink & Chemicals, Inc.). The same evaluations as those in Example 27 were carried out, and the results thereof are shown in Table 5. In the same way as in Example 27, a high-quality image was obtained.

EXAMPLE 29

40 parts by mass of a Bis-A epoxy resin (epoxy equivalent weight=2000, EPIKOTE 1007, manufactured by JER) as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion, 79 parts by mass of silicone oil (SH200 20 cst, manufactured by Toray Dow Corning Silicone Co., Ltd.) as the carrier liquid (carrier oil), and 1 part by mass of a carboxyl-modified silicone (SF8418, manufactured by Toray Dow Corning Silicone Co., Ltd.) as the reactive compound, was mixed together. By using a bead mill grinder (DYNO-Mill, manufactured by WAB AG), the toner solid portion was finely ground in the carrier liquid, so as to prepare the liquid developer of Example 29 which contained the toner for a liquid developer within the carrier liquid.

Using the obtained liquid developer, the same evaluations as those in Example 1 were carried out. The results are shown in Table 5. In the same way as in Example 1, a high-quality image was obtained.

EXAMPLE 30

A liquid developer was manufactured in the same way as in Example 29, except that the epoxy compound in Example 29 was changed to a novolak epoxy resin (epoxy equivalent weight=190, N-775, manufactured by Dainippon Ink & Chemicals, Inc.). The same evaluations as those in Example 29 were carried out, and the results thereof are shown in Table 5. In the same way as in Example 29, a high-quality image was obtained.

EXAMPLE 31

40 parts by mass of a Bis-A epoxy resin (epoxy equivalent weight=2000, EPIKOTE 1007, manufactured by JER) as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion, 79 parts by mass of silicone oil (SH200 20 cst, manufactured by Toray Dow Corning Silicone Co., Ltd.) as the carrier liquid (carrier oil), and 1 part by mass of a mercapto-modified silicone (KF-2001, manufactured by Shin-Etsu Chemical Co., Ltd.) as the reactive compound, was mixed together. By using a bead mill grinder (DYNO-Mill, manufactured by WAB AG), the toner solid portion was finely ground in the carrier liquid, so as to prepare the liquid developer of Example 31 which contained the toner for a liquid developer within the carrier liquid.

Using the obtained liquid developer, the same evaluations as those in Example 1 were carried out. The results are shown in Table 5. In the same way as in Example 1, a high-quality image was obtained.

EXAMPLE 32

A liquid developer was manufactured in the same way as in Example 31, except that the epoxy compound in Example 31 was changed to a novolak epoxy resin (epoxy equivalent weight=190, N-775, manufactured by Dainippon Ink & Chemicals, Inc.). The same evaluations as those in Example 31 were carried out, and the results thereof are shown in Table 5. In the same way as in Example 31, a high-quality image was obtained.

EXAMPLE 33

40 parts by mass of a Bis-A epoxy resin (epoxy equivalent weight=2000, EPIKOTE 1007, manufactured by JER) as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion, 79 parts by mass of silicone oil (SH200 20 cst, manufactured by Toray Dow Corning Silicone Co., Ltd.) as the carrier liquid (carrier oil), and 1 part by mass of an epoxy-modified silicone (SF-8413, manufactured by Toray Dow Corning Silicone Co., Ltd.) as the reactive compound, was mixed together. By using a bead mill grinder (DYNO-Mill, manufactured by WAB AG), the toner solid portion was finely ground in the carrier liquid, so as to prepare the liquid developer of Example 33 which contained the toner for a liquid developer within the carrier liquid.

Using the obtained liquid developer, the same evaluations as those in Example 1 were carried out. The results are shown in Table 5. In the same way as in Example 1, a high-quality image was obtained.

EXAMPLE 34

A liquid developer was manufactured in the same way as in Example 33, except that the epoxy compound in Example 33 was changed to a novolak epoxy resin (epoxy equivalent weight=190, N-775, manufactured by Dainippon Ink & Chemicals, Inc.). The same evaluations as those in Example 33 were carried out, and the results thereof are shown in Table 5. In the same way as in Example 33, a high-quality image was obtained.

EXAMPLE 35

40 parts by mass of a Bis-A epoxy resin (epoxy equivalent weight=2000, EPIKOTE 1007, manufactured by JER) as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion, 79 parts by mass of silicone oil (SH200 20 cst, manufactured by Toray Dow Corning Silicone Co., Ltd.) as the carrier liquid (carrier oil), and 1 part by mass of a vinyl-modified silicone (LR3003/10A, manufactured by Wacker Asahikasei Silicone Co., Ltd.) as the reactive compound, was mixed together. By using a bead mill grinder (DYNO-Mill, manufactured by WAB AG), the toner solid portion was finely ground in the carrier liquid, so as to prepare the liquid developer of Example 35 which contained the toner for a liquid developer within the carrier liquid.

Using the obtained liquid developer, the same evaluations as those in Example 1 were carried out. The results are shown in Table 5. In the same way as in Example 1, a high-quality image was obtained.

EXAMPLE 36

A liquid developer was manufactured in the same way as in Example 35, except that the epoxy compound in Example 35 was changed to a novolak epoxy resin (epoxy equivalent weight=190, N-775, manufactured by Dainippon Ink & Chemicals, Inc.). The same evaluations as those in Example 35 were carried out, and the results thereof are shown in Table 5. In the same way as in Example 35, a high-quality image was obtained.

EXAMPLE 37

40 parts by mass of a Bis-A epoxy resin (epoxy equivalent weight=2000, EPIKOTE 1007, manufactured by JER) as the binder resin, 40 parts by mass of a Bis-A epoxy resin (epoxy equivalent weight=475, EPIKOTE 1001, manufactured by JER) as the epoxy compound, and 20 parts by mass of a cyan pigment (HOSTAPERM BLUE B2G, manufactured by Clariant) as the colorant, were mixed together and stirred by a ball mill. The mixture was melted and kneaded by an extruder heated to a melting/kneading temperature of 100° C., and then cooled and solidified. Thereafter, coarse grinding was carried out by a cutter mill grinder such that the toner solid portion was prepared.

Next, a composition formed from 20 parts by mass of the toner solid portion, 79 parts by mass of silicone oil (SH200 20 cst, manufactured by Toray Dow Corning Silicone Co., Ltd.) as the carrier liquid (carrier oil), and 1 part by mass of a hydroxy-modified silicone (KF-6003, manufactured by Toray Dow Corning Silicone Co., Ltd.) as the reactive compound, was mixed together. By using a bead mill grinder (DYNO-Mill, manufactured by WAB AG), the toner solid portion was finely ground in the carrier liquid, so as to prepare the liquid developer of Example 37 which contained the toner for a liquid developer within the carrier liquid.

Using the obtained liquid developer, the same evaluations as those in Example 1 were carried out. The results are shown in Table 5. In the same way as in Example 1, a high-quality image was obtained.

EXAMPLE 38

A liquid developer was manufactured in the same way as in Example 37, except that the epoxy compound in Example 37 was changed to a novolak epoxy resin (epoxy equivalent weight=190, N-775, manufactured by Dainippon Ink & Chemicals, Inc.). The same evaluations as those in Example 37 were carried out, and the results thereof are shown in Table 5. In the same way as in Example 37, a high-quality image was obtained.

TABLE 4

| | epoxy compound | | | | carrier liquid | |
|---|---|---|---|---|---|---|
| ex. no. | structure | type no. | manufacturer | epoxy equivalent weight | carrier oil | reactive compound |
| ex. 23 | Bis-A epoxy resin | EPIKOTE 1001 | JER | 475 | ISOPAR H | none |
| ex. 24 | novolak epoxy resin | N-775 | Dainippon Ink & Chemicals | 190 | ISOPAR H | none |
| ex. 25 | Bis-A epoxy resin | EPIKOTE 1001 | JER | 475 | soybean oil | none |
| ex. 26 | novolak epoxy resin | N775 | Dainippon Ink & Chemicals | 190 | soybean oil | none |
| ex. 27 | Bis-A epoxy resin | EPIKOTE 1001 | JER | 475 | silicone oil | amino-modified silicone |
| ex. 28 | novolak epoxy resin | N-775 | Dainippon Ink & Chemicals | 190 | silicone oil | amino-modified silicone |
| ex. 29 | Bis-A epoxy resin | EPIKOTE 1001 | JER | 475 | silicone oil | carboxyl-modified silicone |
| ex. 30 | novolak epoxy resin | N-775 | Dainippon Ink & Chemicals | 190 | silicone oil | carboxyl-modified silicone |
| ex. 31 | Bis-A epoxy resin | EPIKOTE 1001 | JER | 475 | silicone oil | mercapto-modified silicone |
| ex. 32 | novolak epoxy resin | N-775 | Dainippon Ink & Chemicals | 190 | silicone oil | mercapto-modified silicone |
| ex. 33 | Bis-A epoxy resin | EPIKOTE 1001 | JER | 475 | silicone oil | epoxy-modified silicone |
| ex. 34 | novolak epoxy resin | N-775 | Dainippon Ink & Chemicals | 190 | silicone oil | epoxy-modified silicone |
| ex. 35 | Bis-A epoxy resin | EPIKOTE 1001 | JER | 475 | silicone oil | vinyl-modified silicone |
| ex. 36 | novolak epoxy resin | N-775 | Dainippon Ink & Chemicals | 190 | silicone oil | vinyl-modified silicone |
| ex. 37 | Bis-A epoxy resin | EPIKOTE 1001 | JER | 475 | silicone oil | hydroxy-modified silicone |
| ex. 38 | novolak epoxy resin | N-775 | Dainippon Ink & Chemicals | 190 | silicone oil | hydroxy-modified silicone |

TABLE 5

| | initial | | after storage test (50° C., 24 hours) | | degree of change before and after storage test | |
|---|---|---|---|---|---|---|
| toner | weight average particle diameter (μm) | yield value of viscosity (Pa) | weight average particle diameter (μm) | yield value of viscosity (Pa) | rate of change in particle diameter (%) | change in yield value (Pa) |
| ex. 23 | 3.6 | 4 | 3.9 | 8 | 8 | 4 |
| ex. 24 | 3.6 | 3 | 3.8 | 6 | 6 | 3 |
| ex. 25 | 4.2 | 5 | 4.7 | 10 | 10 | 5 |
| ex. 26 | 4.3 | 4 | 4.7 | 8 | 8 | 4 |
| ex. 27 | 2.8 | 0 | 2.9 | 0 | 3 | 0 |
| ex. 28 | 2.7 | 0 | 2.7 | 0 | 0 | 0 |
| ex. 29 | 3 | 1 | 3.2 | 5 | 5 | 4 |
| ex. 30 | 3.1 | 1 | 3.1 | 4 | 0 | 3 |

TABLE 5-continued

| toner | initial | | after storage test (50° C., 24 hours) | | degree of change before and after storage test | |
|---|---|---|---|---|---|---|
| | weight average particle diameter (μm) | yield value of viscosity (Pa) | weight average particle diameter (μm) | yield value of viscosity (Pa) | rate of change in particle diameter (%) | change in yield value (Pa) |
| ex. 31 | 3 | 2 | 3.2 | 7 | 6 | 5 |
| ex. 32 | 3 | 1 | 3.0 | 5 | 1 | 4 |
| ex. 33 | 2.9 | 1 | 3.1 | 6 | 5 | 5 |
| ex. 34 | 3 | 1 | 3.0 | 5 | 1 | 4 |
| ex. 35 | 3.2 | 2 | 3.4 | 6 | 7 | 4 |
| ex. 36 | 3.2 | 2 | 3.3 | 5 | 2 | 3 |
| ex. 37 | 3.1 | 0 | 3.3 | 2 | 5 | 2 |
| ex. 38 | 3 | 0 | 3.0 | 0 | 0 | 0 |

From Tables 3 and 5, it can be understood that when the epoxy equivalent weight in the epoxy compound is 1000 or less, it is possible to obtain a toner for a liquid developer having low cohesiveness and good dispersability and storage stability (in the storage stability test, the rate of change in the weight average particle diameter before and after the liquid developer was left to stand is 10% or less, and the change in the yield value of the viscosity before and after the liquid developer was left to stand is 5 (Pa) or less).

Further, it can be understood that, by including the reactive compound in the carrier liquid, the weight average particle diameter and the change in the yield value of the viscosity, before and after the storage test, can be reduced even more. This is thought to be because the reactive compound forms a barrier layer at the surface of the toner for a liquid developer, and causes steric hindrance between the particles of the toner for a liquid developer. Further, the higher the concentration of the epoxy groups exposed at the surface of the toner for a liquid developer, the easier it is for the reactive groups to adsorb to the epoxy groups, and the higher the probability of the reactive compound existing at the surface of the toner for a developer. Thus, it is thought that it becomes even more difficult for the particles of the toner for a liquid developer to cohere to one another, and the dispersability to the toner for a liquid developer improves. Further, the effect is greatest when an amino group is used as the reactive group.

In accordance with the present invention, it is possible to provide a toner for a liquid developer which can overcome the problems of the conventional art and which has low cohesive force and excellent dispersion stability and storage stability and which enables formation of high-quality images and is highly reliable, and to provide a liquid developer which uses the toner for a liquid developer and which has low cohesive force and excellent dispersion stability and storage stability and which enables the formation of high-quality images and is highly reliable, and to provide an image forming device and image forming method which enable formation of high-quality images.

What is claimed is:

1. A toner for a liquid developer, comprising an epoxy compound having epoxy equivalent weight of 1000 or less and a carrier liquid, the carrier liquid containing a reactive compound having at least one selected from amino groups, isocyanate groups, carboxyl groups, mercapto groups, epoxy groups, vinyl groups, and hydroxyl groups.

2. A toner for a liquid developer according to claim 1, wherein the epoxy compound is at least one selected from bisphenol A epoxy resins, novalak epoxy resins, bisphenol F epoxy resins, biphenyl epoxy resins, isocyanate-modified epoxy resins, naphthalene epoxy resins, dicyclo epoxy resins, and brominated epoxy resins.

3. A toner for a liquid developer according to claim 1, wherein the reactive compound has a siloxane structure.

4. A toner for a liquid developer according to claim 1, wherein the carrier liquid contains at least one selected from aliphatic hydrocarbons, silicone oils, vegetable oils, and synthetic oils.

5. A toner for a liquid developer according to claim 1, wherein a weight average particle diameter of the toner is 20 μm or less.

6. A toner for a liquid developer according to claim 1, further comprising a colorant, and a contained amount of the colorant is 2 to 40% by mass.

7. A toner for a liquid developer according to claim 1, further comprising a wax, and a contained amount of the wax is 1 to 50% by mass.

8. A toner for a liquid developer according to claim 7, wherein a dispersion diameter of the wax is 5 μm or less.

9. A toner for a liquid developer according to claim 1, wherein a change in particle diameter of the toner before and after the toner for a liquid developer is left to stand for 24 hours at 50° C. is 10% or less.

10. A toner for a liquid developer according to claim 1, wherein a change in yield value of viscosity before and after the toner for a liquid developer is left to stand for 24 hours at 50° C. is 5 Pa or less.

11. A liquid developer comprising a toner for a liquid developer, wherein the toner for a liquid developer comprises an epoxy compound having an epoxy equivalent weight of 1000 or less and a carrier liquid, the carrier liquid containing a reactive compound having at least one selected from amino groups, isocyanate groups, carboxyl groups, mercapto groups, epoxy groups, vinyl groups, and hydroxyl groups.

12. An image forming device comprising:

an electrostatic latent image carrier;

means for forming an electrostatic latent image on the electrostatic latent image carrier;

means for developing the electrostatic latent image with a liquid developer, forming a visible image, and which accommodates the liquid developer; and means for transferring the visible image onto a transfer material, wherein the liquid developer comprises a toner for a liquid developer, the toner for a liquid developer comprises an epoxy compound having an epoxy equivalent weight of 1000 or less.

13. An image forming method comprising:

a step for forming an electrostatic latent image on an electrostatic latent image carrier;

a step for developing the electrostatic latent image by using a liquid developer, and forming a visible image; and a step for transferring the visible image onto a transfer material, wherein the liquid developer comprises a toner for a liquid developer, the toner for a liquid developer comprises an epoxy compound having an epoxy equivalent weight of 1000 or less.

* * * * *